US006388219B2

(12) United States Patent
Hsu et al.

(10) Patent No.: US 6,388,219 B2
(45) Date of Patent: May 14, 2002

(54) COMPUTER KEYBOARD KEY DEVICE MADE FROM A RIGID PRINTED CIRCUIT BOARD

(75) Inventors: Chien-Shih Hsu; Pin-Chien Liao, both of Tao-Yuan Hsien (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 09/764,397

(22) Filed: Jan. 19, 2001

(30) Foreign Application Priority Data

May 3, 2000 (TW) ..... 89108446 A

(51) Int. Cl.[7] ..... H01H 1/10
(52) U.S. Cl. ..... 200/517; 200/345; 400/491.2
(58) Field of Search ..... 200/344, 345, 200/517; 400/491, 491.2, 490

(56) References Cited

U.S. PATENT DOCUMENTS 5,743,383 A * 4/1998 Yano et al. ..... 200/344
5,799,772 A * 9/1998 Sanda et al. ..... 200/344
5,842,798 A * 12/1998 Su ..... 400/491.2
5,847,337 A * 12/1998 Chen ..... 200/5 A
5,973,281 A * 10/1999 Tsai ..... 200/344
6,107,584 A * 8/2000 Yoneyama ..... 200/344

* cited by examiner

*Primary Examiner*—Lincoln Donovan
*Assistant Examiner*—Kyung S. Lee
(74) *Attorney, Agent, or Firm*—Winston Hsu

(57) ABSTRACT

A key device for a computer keyboard has a rigid printed circuit board, a flexible printed circuit board, and a key structure. The rigid printed circuit board has two adjacent but unconnected conductive ends electrically connected to two wires respectively. The flexible printed circuit board, fixed over the rigid printed circuit board, has a conductive segment installed above the two conductive ends, and an isolation layer installed around the conductive segment to form a gap between the conductive segment and the two conductive ends. The key structure is moveably fixed on the flexible printed circuit board in an up and down manner. When the key structure is pushed downward, the bottom of the key structure will touch the conductive segment of the flexible printed circuit board, and the conductive segment will touch the two conductive ends of the rigid printed circuit board to electrically connect the two conductive ends and the two wires.

6 Claims, 5 Drawing Sheets

COMPUTER KEYBOARD KEY DEVICE MADE FROM A RIGID PRINTED CIRCUIT BOARD

BACKGROUND OF INVENTION

1. Field of the Invention

The present invention discloses a key device for a computer keyboard. More particularly, the key circuit of the computer keyboard is made from a rigid printed circuit board.

2. Description of the Prior Art

Please refer to FIG. 1 and FIG. 2. FIG. 1 is a schematic diagram of a known computer keyboard 10. A sectional view along line 2—2 of the computer keyboard 10 is shown in FIG. 2. The computer keyboard 10 has a plastic housing 12 and a plurality of key devices 14 fixed inside the plastic housing 12.

The key device 14 includes two stacked flexible printed circuit board 16, and 18. The bottom surface 20 of the upper flexible printed circuit board 16, and the upper surface 22 of the lower flexible printed circuit board 18 each have a conductive segment 24 and 26 respectively. A soft plastic segment 28 is installed between the two printed circuit boards 16, 18. A metal plate 13 is installed on the printed circuit board 16. A supporting plate 17 is installed under the printed circuit board 18 to provide the supporting force needed for pushing the key device 14. The soft plastic segment 28 has a hole 30 positioned between the conductive segments 24, 26, and the hole 30 makes a gap between the conductive segments 24, 26.

The key device 14 further includes a keycap 32, a scissors-like support 34 that is moveable in up and down directions to fix the keycap 32 onto the flexible printed circuit board 32. An elastic component 36, installed between the keycap 32 and the flexible printed circuit board 16, upwardly supports the keycap 32 in an elastic manner. When the keycap 32 is pushed downward, the bottom surface of the elastic component 36 will touch the conductive segment 24 of the flexible printed circuit board 16, causing the conductive segment 24 to form an electrical connection with the conductive segment 26 of the flexible printed circuit board 18.

Please refer to FIG. 3. FIG. 3 is a schematic diagram of the partial structure of another key device 40 according to the prior art for a computer keyboard 10. The key device 40 includes two stacked flexible printed circuit boards 42 and 44, which are adhered together. Isolation layers 54 and 56 are installed on the flexible printed circuit boards 42 and 44, respectively. The isolation layers 54 is printed on the bottom surface 46 of the flexible printed circuit board 42, and the isolation layer 56 is printed on the upper surface 48 of the flexible printed circuit board 44. The isolation layers 54, 56 encircle the conductive segments 50 and 52, respectively. Because the isolation layer 54 protrudes from the bottom surface 46 of the flexible printed circuit board 42, and the isolation layer 56 protrudes from the upper surface 48 of the flexible printed circuit board 44, the thickness of the two isolation layers 54 and 56 creates a gap between the two conductive segments 50 and 52.

Because of their flexible nature, decoders cannot be soldered onto the flexible printed circuit boards 16, 18 and 42, 44. Therefore, the computer keyboard 10 can not produce decoded key signals. Instead, it must be connected to a decoding circuit (not shown) through signal lines to produce the corresponding decoded key signals.

Furthermore, the supporting plate 17 is used only to provide the supporting force needed to push the key device 14.

SUMMARY OF THE INVENTION

It is therefore an objective of the present invention to provide a key device that uses a rigid printed circuit board to solve the above-mentioned problems.

Briefly, the present invention provides a way to combine a rigid printed circuit board and a flexible printed circuit board together to form a different key device upon which can be soldered a decoder. The computer keyboard can thus produce decoded key signals without the use of an external decoding circuit.

These and other objectives of the present invention will no doubt become obvious to those of ordinary skill in the art after reading the following detailed description of the preferred embodiment, which is illustrated in the various figures and drawings.

DETAILED DESCRIPTION OF THE PREFERRED EMBODIMENT

Figure 1:
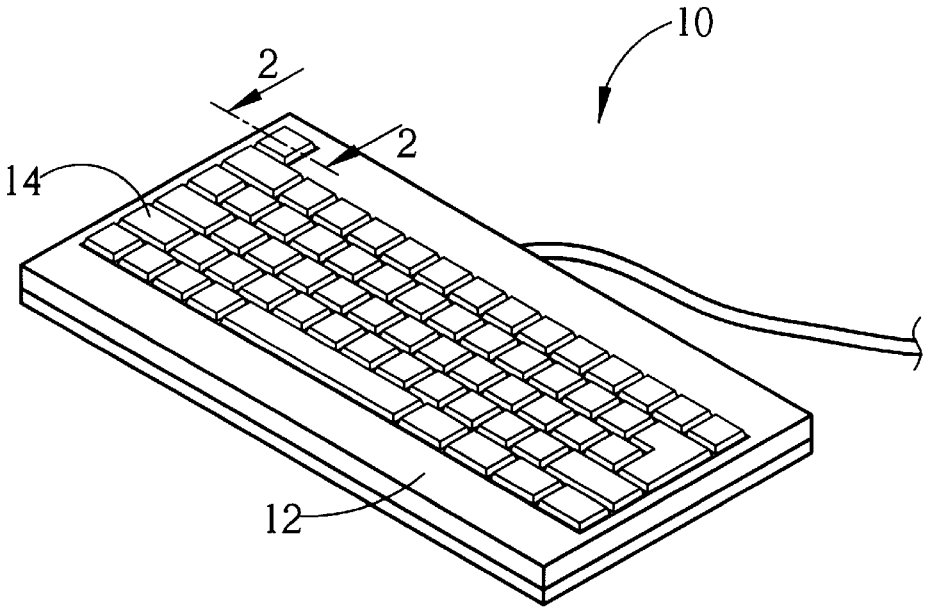
Fig. 1 Prior art
FIG. 1 is a schematic diagram of a computer keyboard according to the prior art.
Figure 2:
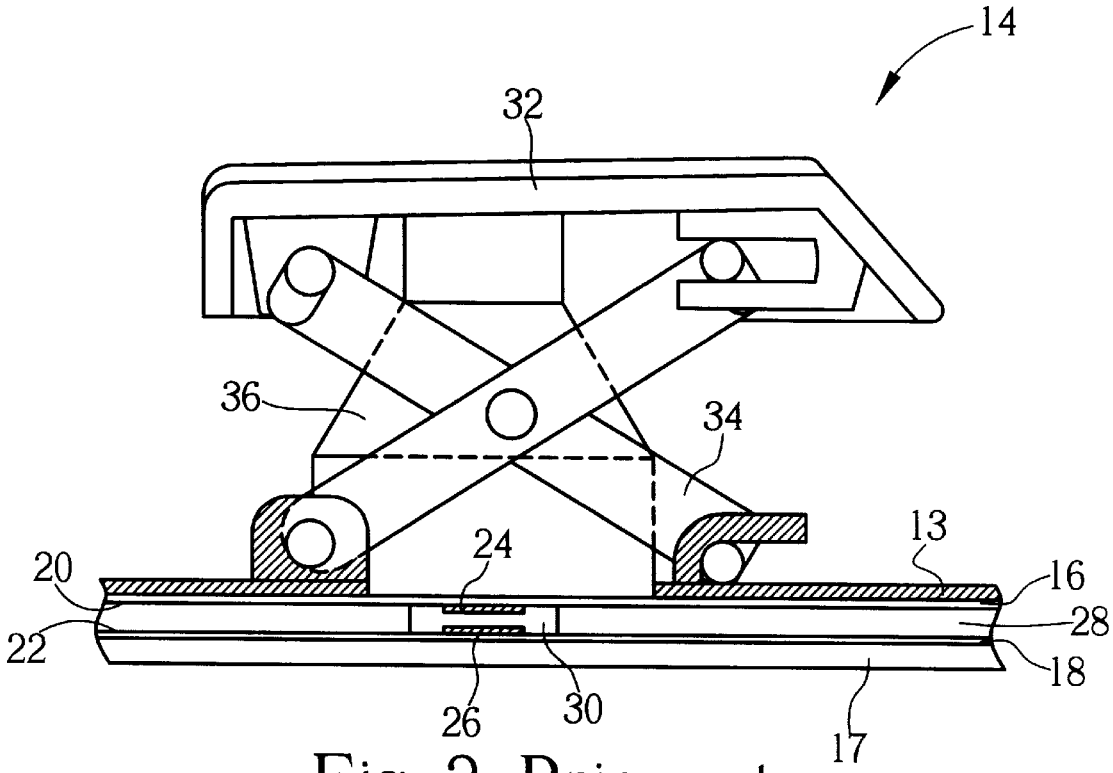
Fig. 2 Prior art
FIG. 2 is a sectional view along line 2—2 of the computer keyboard shown in FIG. 1.
Figure 3:
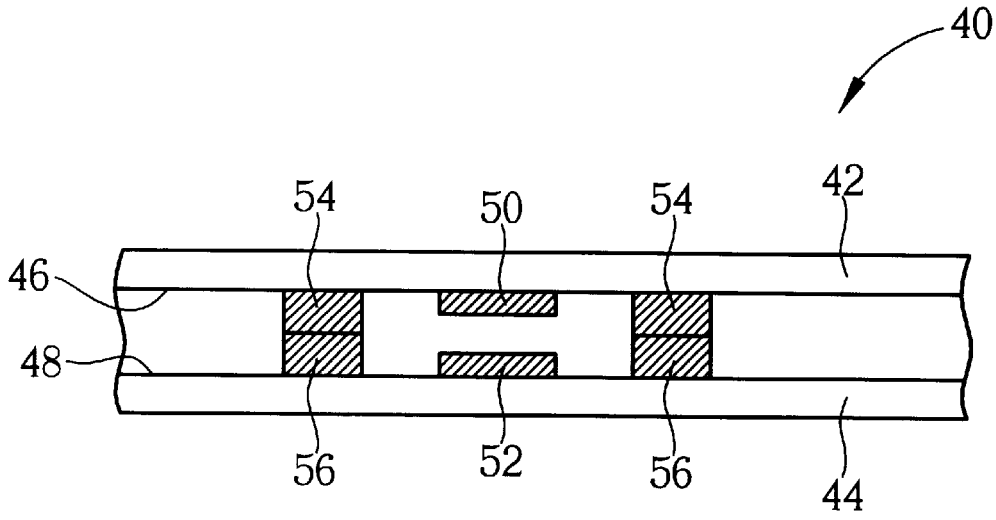
Fig. 3 Prior art
FIG. 3 is a schematic diagram of a partial structure of an alternative key device according to the prior art for the computer keyboard shown in FIG. 1.
Figure 4:
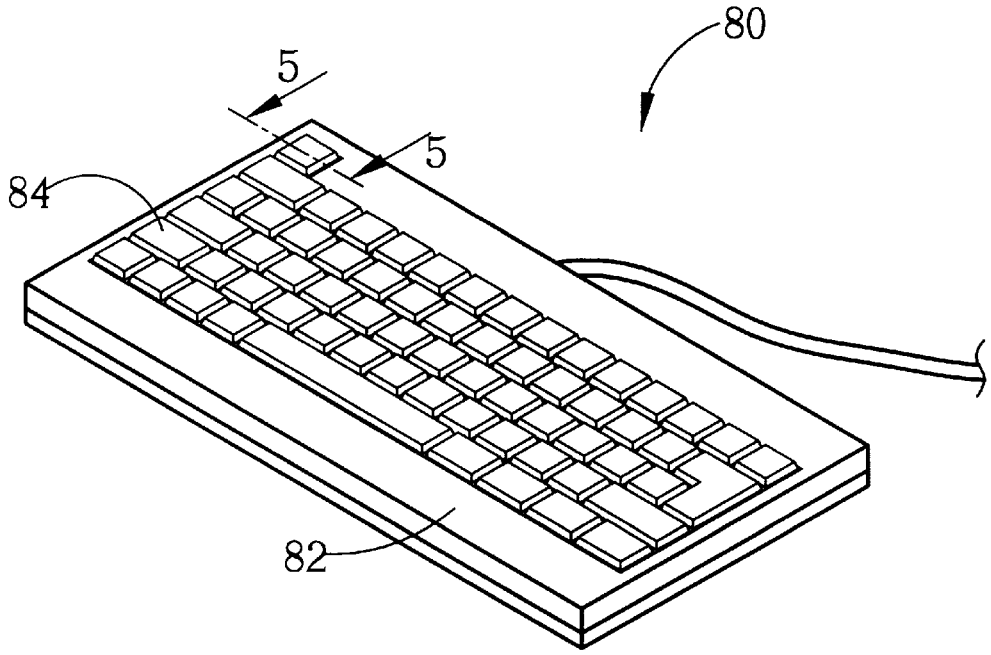
FIG. 4 is a schematic diagram according to the present invention.
Figure 5:
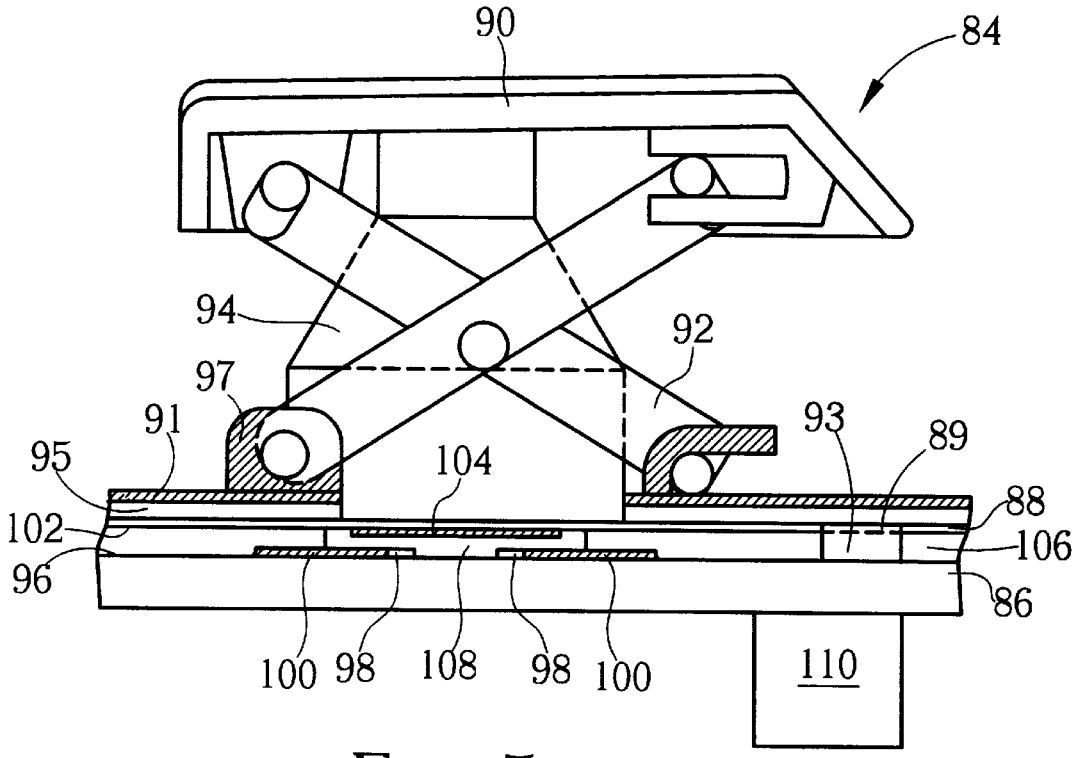
FIG. 5 is a sectional view along line 5—5 of the computer keyboard shown in FIG. 4.

Please refer to FIG. 4 and FIG. 5. FIG. 4 is a schematic diagram of a computer keyboard 80 according to the present invention, and FIG. 5 is a sectional view along line 5—5 of the computer keyboard 80. The computer keyboard 80 includes a plastic housing 82, and plurality of key devices 84 fixed on the plastic housing 82.

As the first embodiment of the present invention shown on FIG. 5, the key device 84 includes a keycap 90, a rigid printed circuit board 86, a flexible printed circuit board 88, a soft plastic segment 106, a metal plate 91, and an elastic component 94. The rigid circuit board 86 is installed inside the plastic housing 82, and the flexible printed circuit board 88 is fixed over the rigid printed circuit board 86. The soft plastic segment 106 is fixed between the rigid printed circuit board 86 and the flexible printed circuit board 88. A plurality of holes 89 are formed on the flexible printed circuit board 88. A plurality of holes 93 are formed on the soft plastic segment 106, and each of the plurality of holes 93 is positioned right below one of the holes 89 to expose a portion of the upper surface of the rigid printed circuit board 86. The metal plate 91 is fixed on the flexible printed circuit board 88, and a scissors-like support 92 that is moveable in an up and down direction for fixing the keycap 90 is fixed on the metal plate 91. The elastic component 94 for upwardly supporting the keycap 90 is installed between the keycap 90 and the flexible printed circuit board 88. The metal plate 91 has a pinched portion 97 to support the scissors-like support 92.

A thermal setting plastic layer 95 is installed between the metal plate 91 and the flexible printed circuit board. By applying heat, the thermal setting plastic layer 95 becomes adhesive and melted, and then the melted thermal setting plastic layer 95 will fill up the holes 89 and 93. The thermal setting plastic layer 95 adheres together the metal plate 91 and the flexible printed circuit board 88, and also adheres the metal plate 91 to the rigid printed circuit board 86 through the holes 89 and 93.

There are other choices for installing the thermal setting plastic layer 95, it may be installed between the flexible printed circuit board 88 and the soft plastic segment 106, or between the soft plastic segment 106 and the rigid printed circuit board 86. In these cases, the thermal setting plastic layer 95 still can adhere together different devices of each layer by filling up the holes 89 and 93.

Additionally, the thermal setting plastic layer 95 may be installed between the two printed circuit board 88 and 86 to replace the soft plastic segment 106. In this case, there is no hole formed on the thermal setting plastic layer 95 under the holes 89 of the flexible printed circuit board 88. The thermal setting plastic layer 95 thus adheres the two printed circuit board 88 and 86 together, and simultaneously adheres the metal plate 91 to the flexible printed circuit board 88 through the holes 89 of the flexible printed circuit board 88.

The upper surface 96 of the rigid printed circuit board 86 has two adjacent but unconnected conductive ends 98, and two wires 100 electrically connected with the two conductive ends 98 respectively. The bottom surface 102 of the flexible printed circuit board 88 has a conductive segment 104 extended over the two conductive ends 98 of the rigid printed circuit board 86. The soft plastic segment 106 has a hole 108 formed between the conductive segment 104 and the two conductive ends 98, and the thickness of the soft plastic segment 106 defines a gap between the conductive segment 104 and the two conductive ends 98.

When the thermal setting plastic layer 95 is installed between the two printed circuit boards 86, 88, the thermal setting plastic layer 95 will have a hole formed at the position corresponding to the hole 108 of the soft plastic segment 106 to allow the two conductive ends 98 can selectively contact with the conductive segment 104.

When the keycap is pushed downward, the bottom of the elastic component 94 will touch the conductive segment 104 of the flexible printed circuit board 88, bringing the conductive segment 104 into contact with the two conductive ends 98 of the rigid printed circuit board 86, and thus electrically connecting together the two conductive ends 98.

The required electrical components of the computer keyboard 80 can be selectively fixed onto the upper or the bottom surface of the rigid printed circuit board 86. For example, a decoder 110 can be soldered on the bottom surface, and the two wires 100 and conductive ends 98 are then electrically connected to the decoder 110. When the decoder 110 detects that the two conductive ends 98 are electrically conducted to each other, the decoder 110 will produce a corresponding key signal.

Figure 6:
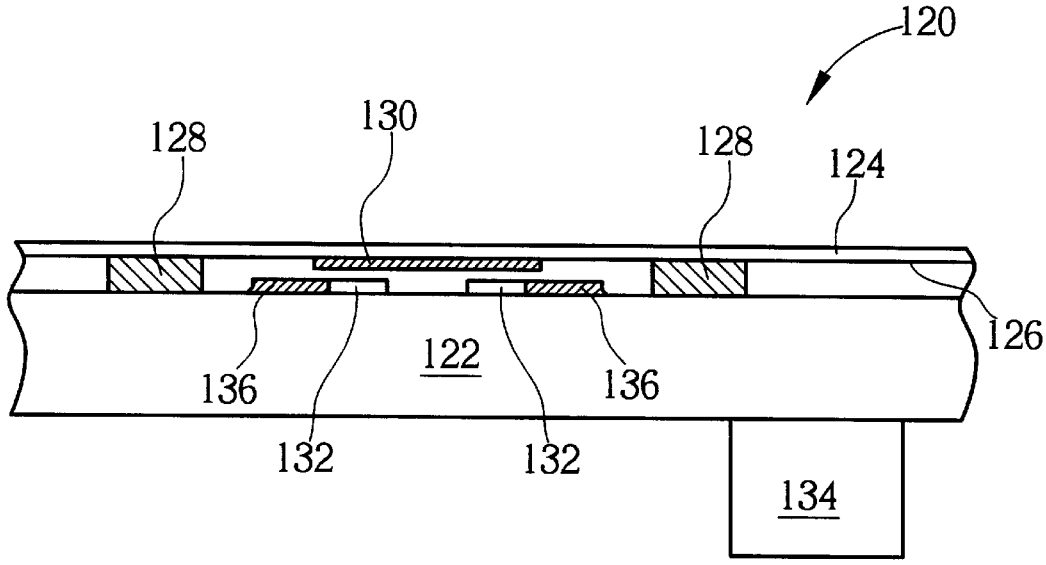
FIG. 6 is a schematic diagram of a partial structure of an alternative key device for the computer keyboard shown in FIG. 4.

Please refer to the second embodiment shown on FIG. 6. FIG. 6 is a schematic diagram of the partial structure of an alternative key device 120 for the computer keyboard 80. The key device 120 includes a rigid printed circuit board 122 and a flexible printed circuit board 124 fixed over the rigid printed circuit board 122. A dielectric layer 128, known as the isolation layer, is printed on the bottom surface 126 of the flexible printed circuit board 124. This dielectric layer 128 encircles a conductive segment 130, and it defines a gap between the conductive segment 130 and two conductive ends 132. By applying heat, a thermal setting plastic layer (not shown) disposed between circuit boards 124 and 122 becomes melted and adhesive for bonding the circuit boards 124 and 122 together.

A decoder 134 electrically connected to the two wires 136 and the conductive ends 132 is fixed on the upper or the bottom surface of the rigid printed circuit board 122. When the decoder 134 detects that the two conductive ends 132 are electrically conducted to each other (via the conductive segment 130), the decoder 134 will produce a corresponding key signal.

As the two embodiments shown above, because the conductive segments 104, 130 on the bottom surfaces 102, 126 of the flexible printed circuit boards 88, 124 occupy very small area, the volume of the elastic component 94 can be reduced. The volume of the key devices 84, 120 can thus be reduced, and it will make the keyboard 80 more compact. The rigid printed circuit boards 86, 122 have a strong structure that can withstand the downward force needed to depress the key 90, as well as accommodating other required electrical components, such as the decoders 110 and 134. These decoders can be soldered onto the rigid printed circuit boards 86, 122 to produce decoded key signals.

Figure 7:
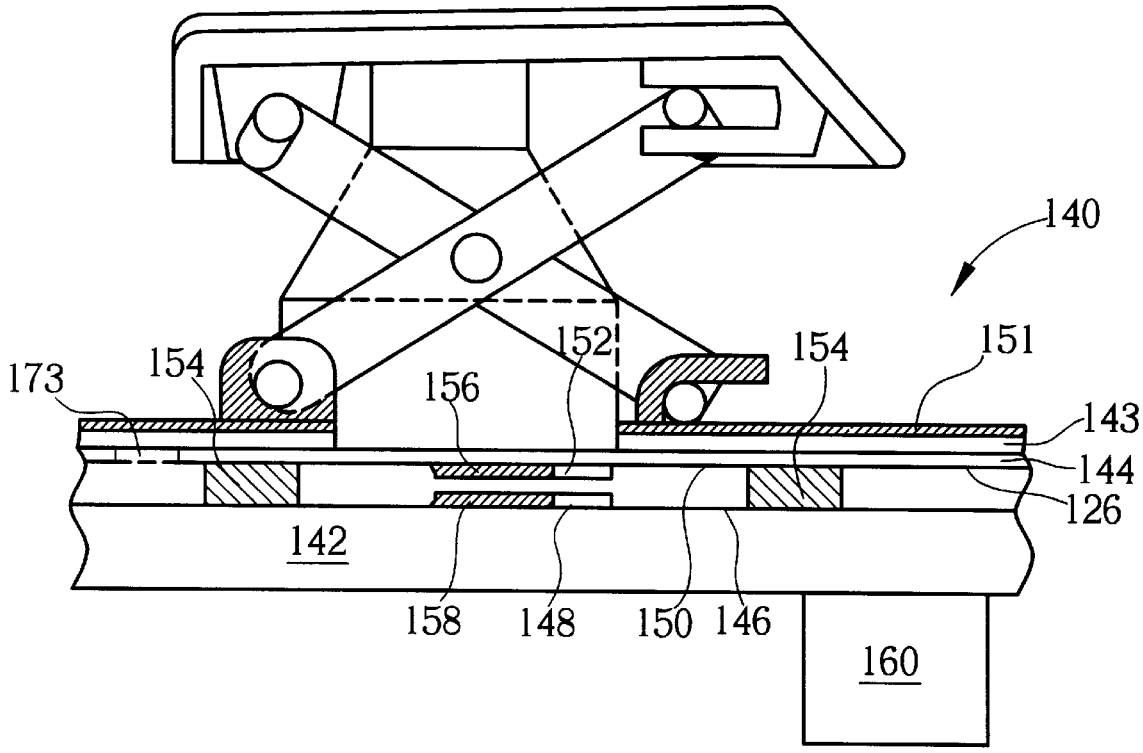
FIG. 7 is a schematic diagram of a partial structure of a third embodiment of the key devices for the computer keyboard shown in FIG. 4.

Please refer to FIG. 7. FIG. 7 is a schematic diagram of the partial structure of the third embodiment of the present invention, a key device 140 for the computer keyboard 80. The key device 140 includes a metal plate 151, a rigid printed circuit board 142 fixed under the metal pate 151, and a flexible printed circuit board 144 fixed between the metal plate 151 and the rigid printed circuit board 142. A first conductive end 148 is formed on the upper surface 146 of the rigid printed circuit board 142, and a second conductive contact 152 is formed on the bottom surface 150 of the flexible printed circuit board 144 and right above the first conductive end 148. A dielectric layer 154, known as an isolation layer, is printed on the bottom surface 150 of the flexible printed circuit board 144, which encircles the second conductive end 152. The dielectric layer 154 protrudes from the bottom surface 150 of the flexible printed circuit board 144 to form a gap between the two conductive ends 148, 152.

A thermal setting plastic layer 143 is installed between the metal plate 151 and the flexible printed circuit board 144. The flexible printed circuit board 144 has a plurality of holes 173 to expose a portion of the upper surface of the rigid printed circuit board 142. When the thermal setting plastic layer 143 is melted by heat, not only will the metal plate 151 adhere to the flexible printed circuit board 144, but the thermal setting plastic layer 143 will also adhere the rigid printed circuit board 142 to the flexible printed circuit board 144 through the holes 173.

The rigid printed circuit board 142 has at least one wire 158 electrically connected to the first conductive end 148, and the flexible printed circuit board 144 also has at least one wire 156 electrically connected to the second conductive end 152. A decoder 160 is soldered on the rigid printed circuit board 142, which is electrically connected to the two conductive ends 148, 152 and the two wires 158, 156. When the decoder 160 detects that the two conductive ends 148, 152 are electrically conducted together, the decoder 160 will produce a corresponding key signal.

Figure 8:
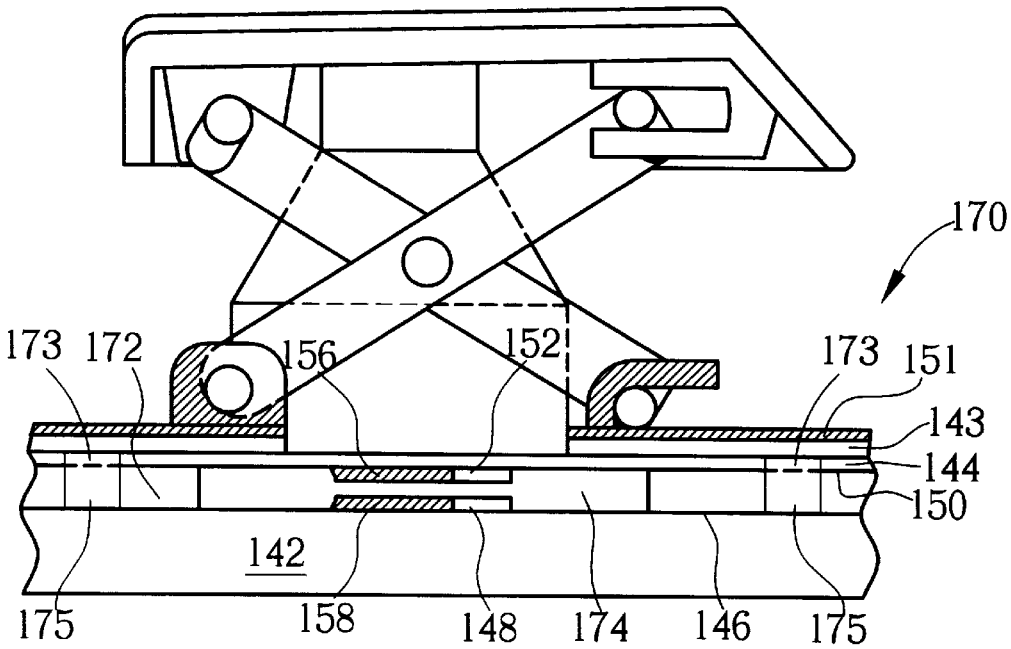
FIG. 8 is a schematic diagram of a partial structure of a fourth embodiment of the key devices for the computer keyboard shown in FIG. 4.

Please refer to FIG. 8. FIG. 8 is a schematic diagram of the partial structure of the fourth embodiment of the present invention, a key device 170 for the computer keyboard 80. The difference between the key device 170 and 140 is the inclusion of a soft plastic segment 172 between the bottom surface 150 of the flexible printed circuit board 144 and the upper surface 146 of the rigid printed circuit board 142 to replace the dielectric layer 154 shown in FIG. 7.

The soft plastic segment 172 has a plurality of holes 175, and a hole 174 under the second conductive end 152 to form a gap between the second conductive end 152 and the first conductive end 148. The flexible printed circuit board 144 also has a plurality of holes 173 that correspond to the holes 175 of the soft plastic segment 172. When the thermal setting plastic layer 143 is melted by heat, not only will the metal plate 151 adhere to the flexible printed circuit board 144, but the thermal setting plastic layer 143 will adhere the rigid printed circuit board 142 under the metal plate 151 to the soft plastic segment 172 through the holes 173 and 175.

The thermal setting plastic layer can also be installed between the flexible printed circuit board 144 and the soft plastic segment 172, or between the soft plastic segment 172 and the rigid printed circuit board 142. The thermal setting plastic layer will adhere together different devices of all the layers through the holes 173 and 175. If the thermal setting plastic layer 143 is of a sufficient thickness, it can replace the soft plastic segment 172 to form the gap between the two printed circuit boards 142 and 144.

Figure 9:
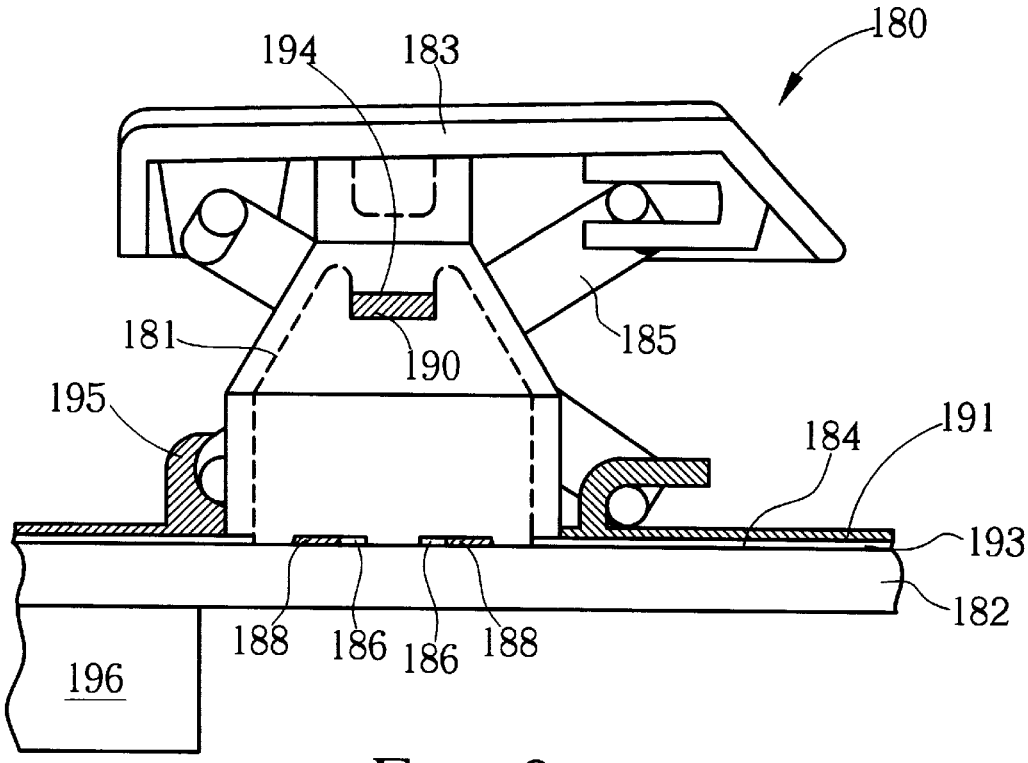
FIG. 9 is a schematic diagram of a partial structure of a fifth embodiment of the key devices for the computer keyboard shown in FIG. 4.

Please refer to FIG. 9. FIG. 9 is a schematic diagram of the partial structure of a fifth embodiment of the present invention, a key device 180 for the computer keyboard 80. The key device 180 includes a keycap 183, a rigid printed circuit board 182 under the keycap 183, a metal plate 191 fixed over the rigid printed circuit board 182, a scissors-like support 185 to moveably fix the keycap 183 on the rigid printed circuit board 182 in an up and down manner, and an elastic component 181 installed between the keycap 183 and the rigid printed circuit board 182 to upwardly and elastically support the keycap 183. A thermal setting plastic layer 193 between the metal plate 191 and the rigid printed circuit board 182 adheres the metal plate 191 to the rigid printed circuit board 182. A plurality of pinched portions 195 on the metal plate 191 are used to support the scissors-like support 185.

The upper surface 184 of the rigid printed circuit board 182 has two adjacent but unconnected conductive ends 186, and two wires 188 electrically connected to the two conductive ends 186, respectively. The inside surface 194 of the elastic component 181 has a conductive segment 190 above the two wires ends 186.

The rigid printed circuit board 182 also has a decoder 196 that is electrically connected to the two conductive ends 186. When the elastic component 181 is pushed downward, the conductive segment 190 will touch the two conductive ends 186, electrically connecting them together. When the decoder 196 senses that the two conductive ends 186 are electrically connected to each other (via the conductive segment 190), the decoder 196 will produce a corresponding signal.

Figure 10:
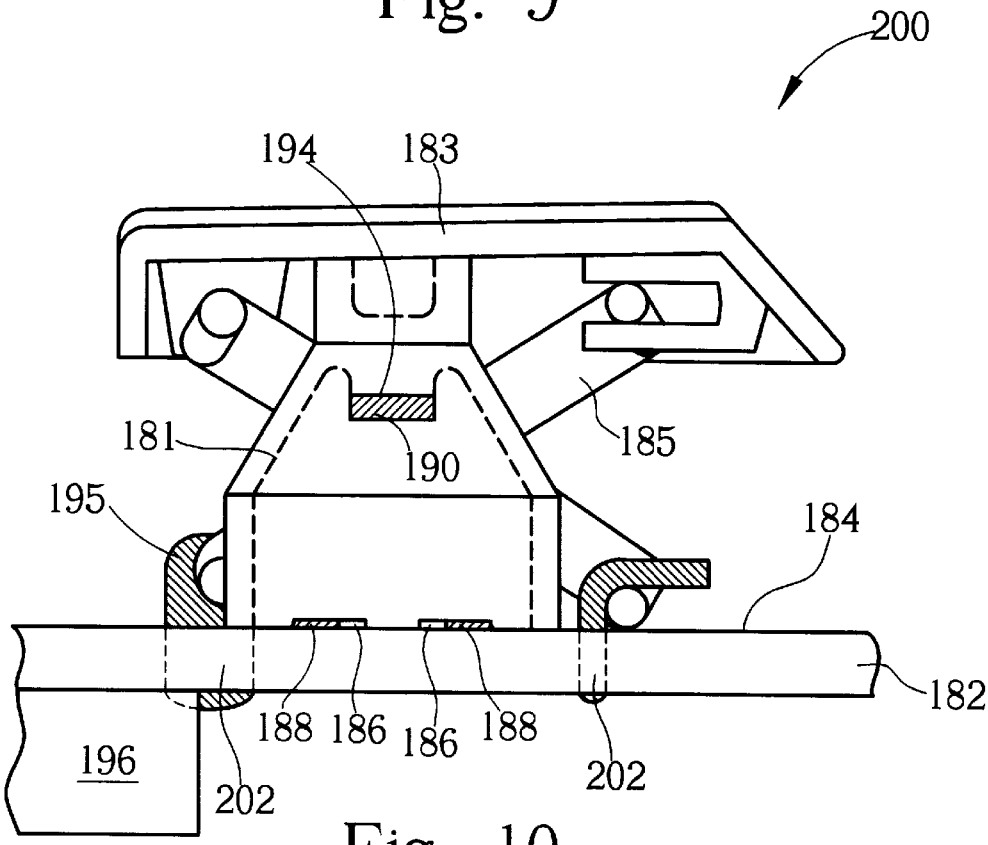
FIG. 10 is a schematic diagram of a partial structure of a sixth embodiment of the key devices for the computer keyboard shown in FIG. 4.

Please refer to FIG. 10. FIG. 10 is a schematic diagram of the partial structure of a sixth embodiment of the present invention, a key device 200 for the computer keyboard 80. The difference between the key device 200 and 180 is that the key device 200 does not have the metal plate 191. Instead, it has a plurality of predetermined holes 202 on the rigid printed circuit board 182 to fix the pinched portion 195 onto the rigid printed circuit board 182 that is used to support the scissors-like support 185. The pinched portion 195 may be directly soldered or screwed onto the rigid printed circuit board 182. The method may also be used in the embodiments that have a flexible printed circuit board.

In contrast to the prior art computer keyboard 10, the key devices 84, 120, 140, 170, 180, and 200 for the computer keyboard 80 according to the present invention include the rigid printed circuit boards 86, 122, 142, and 182. Because of the rigidity of the rigid printed circuit board, there is no need for any supporting plates. Electrical components that may be required can also be installed on the rigid printed circuit board, such as the decoders 110, 134, 160, and 196. The keyboard 80 can thus provide decoded key signals.

Those skilled in the art will readily observe that numerous modifications and alternations of the device may be made while retaining the teachings of the invention. Accordingly, the above disclosure should be construed as limited only by the metes and bounds of the appended claims.

What is claimed is:

1. A key device comprising:

a rigid printed circuit board comprising a first conductive end formed on an upper surface of the rigid printed circuit board;

a flexible printed circuit board fixed over the rigid printed circuit board, the flexible printed circuit board comprising a second conductive end formed on a bottom surface of the flexible printed circuit board and positioned above the first conductive end;

a decoder formed on the rigid printed circuit board, the decoder electrically connected to the first conductive end and to the second conductive end, the decoder producing a corresponding key signal when it detects the first conductive end touching the second conductive end, an isolation layer disposed between the rigid printed circuit board and the flexible printed circuit board, the isolation layer defining a gap between the first conductive end and the second conductive end; and a key structure fixed over the flexible printed circuit board, the key structure being moveable in an up and down manner for selectively pressing the second conductive end downwardly;

wherein when the key structure is pushed downwardly, the key structure forces the second conductive end move downwardly to touch the first conductive end.

2. A switch device comprising:

a rigid printed circuit board having at least one first conductive end on an upper surface of the rigid printed circuit board;

a flexible printed circuit board fixed over the rigid printed circuit board, the flexible printed circuit board comprising at least one second conductive end positioned corresponding to the first conductive end of the rigid printed circuit board;

a decoder formed on the rigid printed circuit board, the decoder electrically connected to the first conductive end and to the second conductive end, the decoder producing a corresponding key signal when it detects the first conductive end touching the second conductive end; and an isolation layer disposed between the rigid printed circuit board and the flexible printed circuit board, the isolation layer forming a gap between the first conductive end and the second conductive end;

wherein the second conductive end of the flexible printed circuit board is pushed downward to touch the first conductive end of the rigid printed circuit board.

3. A key device comprising:

a keycap;

a rigid printed circuit board under the keycap, the rigid printed circuit board comprising two adjacent but not connected conductive ends on an upper surface of the rigid printed circuit board;

a decoder formed on the rigid printed circuit board, the decoder electrically connected to the two conductive ends, the decoder producing a corresponding key signal when it detects that the two conductive ends are electrically conducted together;

a scissors-like support moveable in an up and down manner, the scissors-like support fixing the keycap on the rigid printed circuit board; and an elastic component disposed between the keycap and the rigid printed circuit board, the elastic component comprising a conductive segment, the conductive segment positioned above the two conductive ends of the rigid printed circuit board;

wherein when the keycap is pushed down, the conductive segment of the elastic component touches the two conductive ends of the rigid printed circuit board, electrically conducting the two conductive ends.

4. A key device comprising:

a rigid printed circuit board comprising a first conductive end formed on an upper surface of the rigid printed circuit board;

a flexible printed circuit board fixed over the rigid printed circuit board, the flexible printed circuit board having a second conductive end formed on a bottom surface of the flexible printed circuit board and positioned above the first conductive end, and a hole for exposing a portion of the upper surface of the rigid printed circuit board;

a thermal setting plastic layer disposed between the flexible printed circuit board and a metal plate fixed over the flexible printed circuit board;

an isolation layer disposed between the rigid printed circuit board and the flexible printed circuit board, the isolation layer defining a gap between the first conductive end and the second conductive end; and a key structure fixed over the flexible printed circuit board, the key structure being moveable in an up and down manner for selectively pressing the second conductive end downwardly;

wherein when the key structure is pushed downwardly, the key structure forces the second conductive end move downwardly to touch the first conductive end; and the metal plate and the flexible printed circuit board are fixed onto the rigid printed circuit board by a portion of the thermal setting plastic layer filled within the hole.

5. A key device comprising:

a rigid printed circuit board comprising a first conductive end formed on an upper surface of the rigid printed circuit board;

a flexible printed circuit board fixed over the rigid printed circuit board, the flexible printed circuit board having a second conductive end formed on a bottom surface of the flexible printed circuit board and positioned above the first conductive end, and a hole for exposing a portion of the upper surface of the rigid printed circuit board, a thermal setting plastic layer disposed between the flexible printed circuit board and the rigid printed circuit board;

an isolation layer disposed between the rigid printed circuit board and the flexible printed circuit board, the isolation layer defining a gap between the first conductive end and the second conductive end; and a key structure fixed over the flexible printed circuit board, the key structure being moveable in an up and down manner for selectively pressing the second conductive end downwardly;

wherein when the key structure is pushed downwardly, the key structure forces the second conductive end move downwardly to touch the first conductive end; and the flexible printed circuit board is fixed onto the rigid printed circuit board by a portion of the thermal setting plastic layer filled within the hole.

6. A switch device comprising:

a rigid printed circuit board having at least one first conductive end on an upper surface of the rigid printed circuit board;

a flexible printed circuit board fixed over the rigid printed circuit board, the flexible printed circuit board having at least one second conductive end positioned corresponding to the first conductive end of the rigid printed circuit board; and an isolation layer disposed between the rigid printed circuit board and the flexible printed circuit board, the isolation layer forming a gap between the first conductive end and the second conductive end;

wherein the second conductive end of the flexible printed circuit board is pushed downward to touch the first conductive end of the rigid printed circuit board; and the flexible printed circuit board is fixed to the rigid printed circuit board by a thermal setting bonding method.

* * * * *